US005769603A

United States Patent [19]

Fujiwara et al.

[11] Patent Number: 5,769,603

[45] Date of Patent: Jun. 23, 1998

[54] SUBMERGED PUMP

[75] Inventors: Tetsutaro Fujiwara; Seiichiro Yamada, both of Yokohama; Seiichi Toguchi, Kawasaki, all of Japan

[73] Assignee: Ebara Corporation, Tokyo, Japan

[21] Appl. No.: 683,090

[22] Filed: Jul. 18, 1996

[30] Foreign Application Priority Data

Jul. 20, 1995 [JP] Japan ..... 7-206589

[51] Int. Cl.[6] ..... F04D 29/44

[52] U.S. Cl. ..... 415/169.1; 415/206; 415/211.1; 415/211.2; 415/214.1; 415/225

[58] Field of Search ..... 415/182.1, 203, 415/204, 206, 211.1, 211.2, 214.1, 225, 169.1; 417/423.14; 55/410, 505

[56] References Cited

U.S. PATENT DOCUMENTS

| | | | |
|---|---|---|---|
| 3,167,021 | 1/1965 | Sence . | |
| 4,592,700 | 6/1986 | Toguchi et al. | 415/225 |
| 4,787,816 | 11/1988 | Jensen et al. | 415/169.1 |
| 5,064,344 | 11/1991 | Kassel et al. . | |
| 5,145,337 | 9/1992 | Kirkland . | |

FOREIGN PATENT DOCUMENTS

| | | | |
|---|---|---|---|
| 0 391 352 | 10/1990 | European Pat. Off. . | |
| 2 056 890 | 5/1971 | France . | |
| 31 33 603 | 3/1983 | Germany . | |
| 4-8796 | 1/1992 | Japan . | |
| 5-14589 | 2/1993 | Japan . | |
| 5-14590 | 2/1993 | Japan . | |
| 5-14591 | 2/1993 | Japan . | |
| 0141387 | 6/1993 | Japan | 415/214.1 |
| 7-10499 | 2/1995 | Japan . | |
| 7-10500 | 2/1995 | Japan . | |
| 1225926 | 4/1986 | U.S.S.R. | 415/206 |
| 142 131 | 9/1920 | United Kingdom . | |
| 612 573 | 11/1948 | United Kingdom . | |

OTHER PUBLICATIONS

Patent Abstracts of Japan, vol. 6, No. 216 (M–168), Oct. 29, 1982, JP–57–122194, Jul. 29, 1982.

*Primary Examiner*—Christopher Verdier

*Attorney, Agent, or Firm*—Oblon, Spivak, McClelland, Maier & Neustadt, P.C.

[57] ABSTRACT

A submerged pump used, for example, in a duplex treating tank for sewage includes a pump casing including an inlet portion, a pump chamber and a discharge portion, and a motor for driving and rotating an impeller provided in the pump chamber. The motor is integrally secured to the pump casing. The pump casing has at least two subcasings assembled together, at least one of the subcasings having a projection defining a narrowed passage portion. An obtusely oriented air vent hole is provided in the lower casing.

10 Claims, 3 Drawing Sheets

SUBMERGED PUMP

BACKGROUND OF THE INVENTION

1. Field of the Invention

The present invention relates to a submerged pump for use, for example, in a treatment tank for a multiple sewage system.

2. Description of the Related Art

Japanese Laid-Open Utility Model Application No. 5-14590 discloses a submerged pump in which a motor housed in a stainless steel motor frame is combined with a pump casing made of synthetic resin. In this submerged pump, a so-called open-type casing is employed, which is made by assembling a plurality of casing elements or subcasings, for production and maintenance convenience.

One of the problems of the above-discussed pump is how to prevent a foreign object from clogging in a flow passage or being caught by an impeller. In order to solve the problem, a narrowed passage portion or a bottle neck portion having a diameter smaller than that of an inlet portion is not present along the flow passage of the pump.

Conventionally, an upper casing and a lower casing, which make up the pump casing, are molded with resin in a manner that surfaces facing each other are flat and parallel. Thus, since a diameter of a boundary portion between a pump chamber and a discharge portion is larger than that of the inlet portion, an internal energy loss of the fluid due to a variation in fluid pressure reduces not only pumping efficiency but also a head pressure at a shut off operation flow rate.

SUMMARY OF THE INVENTION

It is therefore an object of the present invention to provide a submerged pump having a casing made of resin for reducing its weight and production cost, which can maintain a high pumping efficiency and prevent lowering of head at a shut off operation flow rate.

According to a first aspect of the present invention, there is provided a submerged pump comprising a pump casing accommodating a shaft rotatably therein and having an inlet portion, a pump chamber and a discharge portion; an impeller integrally mounted on said shaft in said pump chamber; and a motor means for driving said impeller to rotate within said pump chamber, said motor means being integrally secured to said pump casing; wherein said pump casing comprises at least two subcasings assembled together, at least one of said subcasings having a projection defining a narrowed passage portion between said pump chamber and said discharge portion.

According to the first aspect of the present invention, even when the pump casing is made of resin, pumping efficiency is maintained and loss of head is decreased at a shut off operation flow rate.

In the above invention, a minimum diameter of the narrowed passage portion may be equal to or a little larger than a minimum diameter of the inlet portion of the submerged pump. According to the invention, a foreign object entering from the inlet portion is prevented from being entrapped at the narrowed passage portion.

In the above invention, a gap having a diameter equal to or larger than a minimum diameter of the inlet portion may be formed between the impeller and the pump casing. According to the invention, the foreign object is prevented from being entrapped between the impeller and the casing.

In the above invention, a cross-sectional area of the narrowed passage portion may be almost equal to that of the inlet portion. According to the present invention, the cross-section of the flow passage does not change substantially and loss of pressure is prevented.

In the above invention, an air vent hole penetrating an outer side wall of the pump chamber may be formed therein, in a manner that the air vent hole is at an obtuse angle with respect to a fluid flow direction in an outer portion of the pump. According to the invention, the air venting function is maintained and fluid leakage and wear of a periphery portion of the hole are reduced.

In the above invention, the highest contacting face between the subcasings may be arranged approximately as high as or higher than a main shroud of the impeller.

It is another aspect of the present invention to provide a submerged pump comprising a pump casing accommodating a shaft rotatably therein and having an inlet portion, a pump chamber and a discharge portion; an impeller integrally mounted on said shaft in said pump chamber; and a motor means for driving said impeller to rotate within said pump chamber, said motor means being integrally secured to said pump casing; wherein an air vent hole is formed through an outer side wall of said pump chamber, said air vent hole being at an obtuse angle with respect to a fluid flow direction in an outer portion of said pump.

According to the present invention, the air venting function is maintained and fluid leakage and wear of a periphery portion of the hole are reduced.

In the above invention, an angle between the air vent hole and the fluid flow direction may be substantially in a range of 105° to 165°. When the angle is under 105°, reduction of fluid leakage and wearing is not significant on the other hand, when the angle is over 165°, thickness of the wall around the hole is thin, which lowers a mechanical strength of the wall.

Also, it is another aspect of the present invention to provide a vortex-type submerged pump comprising a pump casing accommodating a shaft rotatably therein and having an inlet portion, a pump chamber and a discharge portion; an impeller integrally mounted on said shaft in said pump chamber; and a motor means for driving said impeller to rotate within said pump chamber, said motor means being integrally secured to said pump casing; wherein said pump casing comprises at least two subcasings assembled together, the highest contacting face between said subcasings is arranged approximately as high as or higher than a main shroud of said impeller.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENT

Hereinafter, a preferred embodiment of the present invention will now be described in detail.

Figure 1:
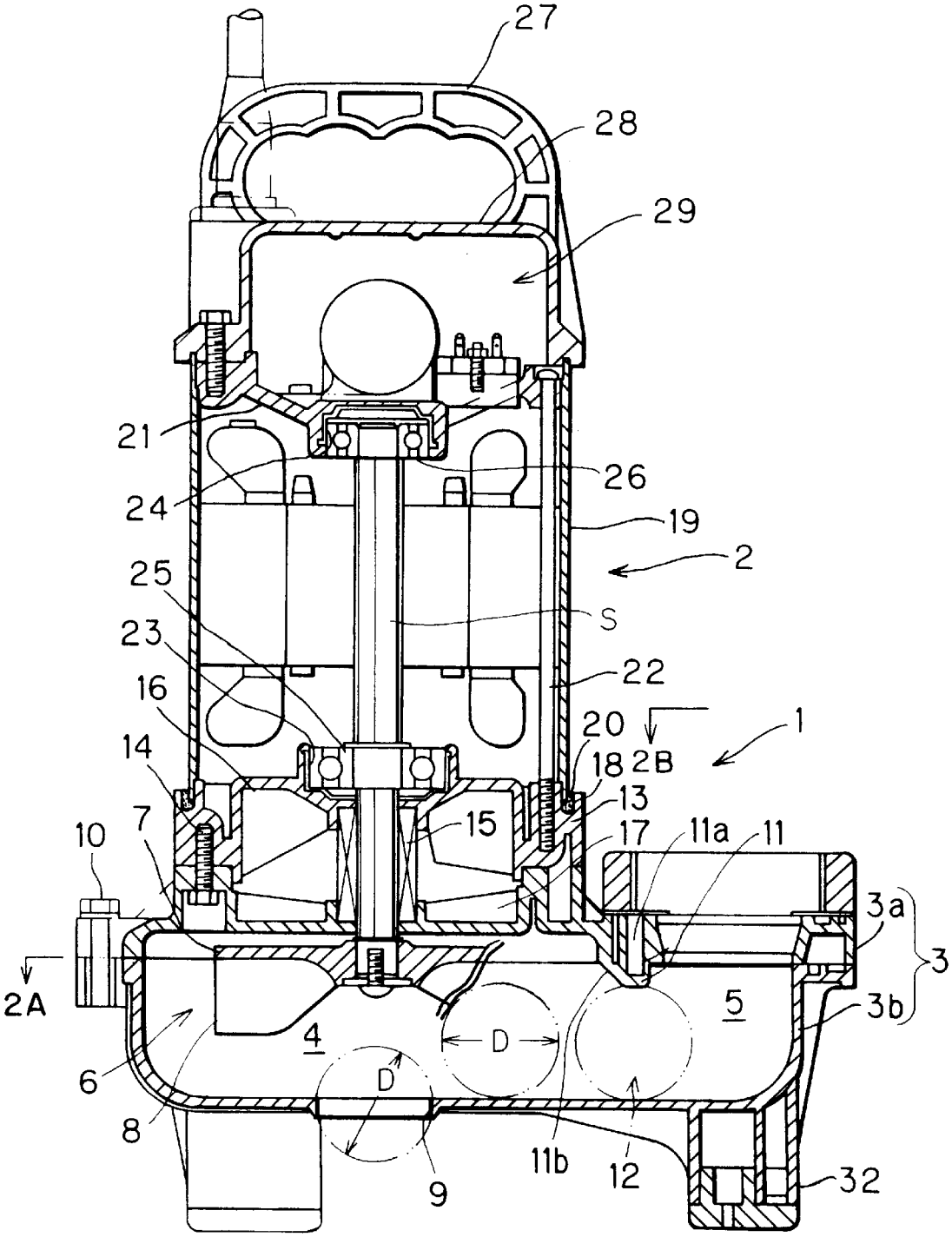
FIG. 1 is a sectional view showing a submerged pump of an embodiment of the present invention.

FIG. 1 shows an embodiment of the submerged pump of the present invention. As shown in FIG. 1, the submerged pump comprises a pump body 1 and a motor 2 integrally provided on the pump body 1.

Figure 2A:
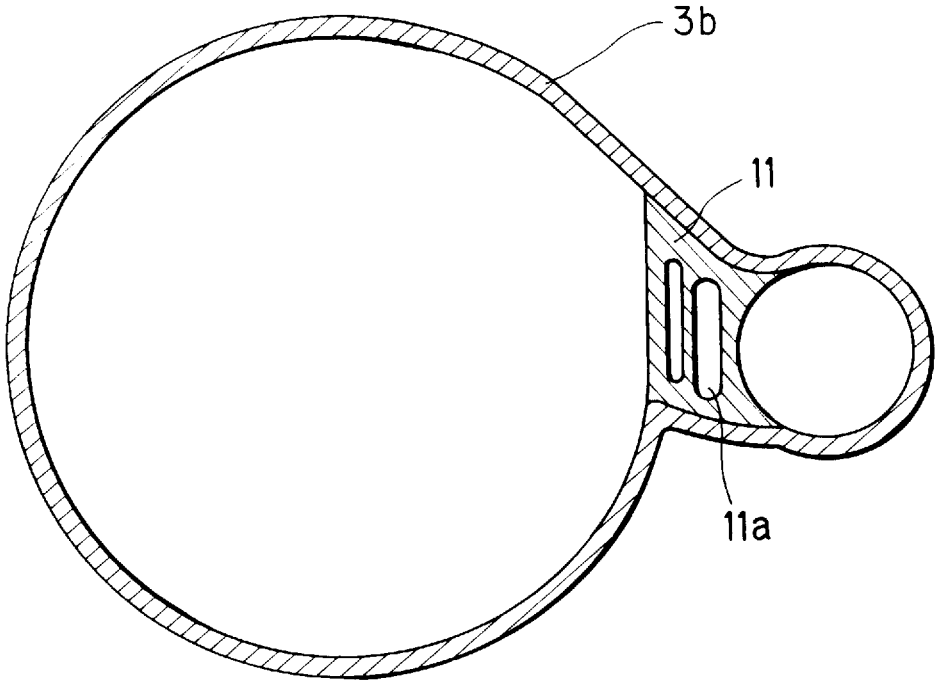
FIG. 2A is a sectional view taken along the line 2A of FIG. 1.

The pump body 1, as shown in FIG. 2A, includes a pump casing of resin, in which a pump chamber 4 and a discharge portion 5 are formed. A main shaft S of the motor 2 is inserted into the pump chamber 4 and provided with an impeller thereon. Vanes 8 are formed only on one side of the main shroud 7 of the impeller 6, to construct a so-called vortex-type pump. In a bottom face of the casing 3, an inlet portion 9 is formed.

The pump casing 3 comprises two casing elements or subcasings, that is, an upper casing 3*a* and a lower casing 3*b* assembled together by bolts 10. These subcasings 3*a*, 3*b* are respectively formed by resin molding to makeup so-called-open-type casings.

Figure 2B:
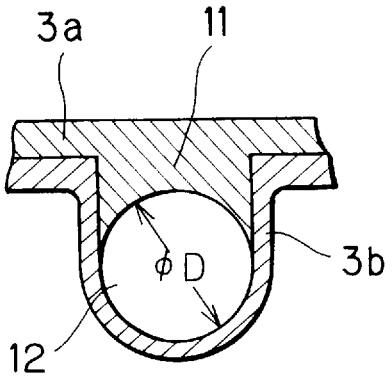
FIG. 2B is a sectional view taken along the line 2B of FIG. 1.

The upper casing 3*a* has, as shown in FIG. 2B, a projection portion 11 projecting downwardly below a boundary portion between the pump chamber 4 and the discharge portion 5. A lower end of the projection portion is formed to have a circular ridge line, which defines a narrowed passage portion also of a circular cross-section. The projection is formed to have a hollow space 11*a* therein for reducing the amount of resin material as well as its weight. The projection 11 is formed with a slope 11*b* on a side facing the pump chamber 4 so as to prevent generation of turbulent flow at the narrowed passage portion. A diameter D of the narrowed passage portion 12 is equal to that of the inlet portion 9 and to a distance between a lower edge of a vane 8 of the impeller 6 and the bottom face of the pump casing 3, which defines a minimum diameter of the flow passage of the pump.

In the impeller 6 of the pump, some (in this example, two) of the vanes are designed to be have a greater height towards the bottom surface than the other vanes so as to improve pumping performance. Although a distance between a lower edge of the wider vanes and the bottom surface of the casing is less than the distance D, a gap is maintained between the vanes, through which a sphere having a diameter D can pass, so as to prevent the foreign object flowing from the inlet portion from being entrapped.

A bearing bracket 13 made of resin is secured by a bolt 14 on the upper portion of the upper casing 3*a* facing the pump chamber 4. Between the upper casing 3*a* and the bearing bracket 13, a mechanical seal element 15 is provided around the main shaft S. On both an upper face of the upper casing 3*a* and a lower face of the bearing bracket 13, radial ribs 16, 17 are provided to extend radially to reinforce these members and prevent the lubricant from being scattered within the space. On the upper end of the cylindrical portion of the bearing bracket 13, a groove 18 extending in a peripheral direction is formed, in which an edge of a motor frame made of corrosion-resistant metal is inserted with a packing material 20.

The upper end of the motor frame 19 is also inserted in a groove formed on the lower surface of an upper bearing bracket 21 made of resin, which is secured to the lower bearing bracket 13 by long bolts 22. On the central portions of the upper and lower brackets 13, 21, recesses 23, 24 are formed to face each other, each of which accommodates a metal washer for securing bearings 25, 26 therein. On the upper bearing bracket 27, a cover 28 made of resin is attached, in which a power controller 29 for controlling the motor is provided.

The pump casing 3 is designed to be divided into upper and lower portions at as high a level as molding is possible. In this embodiment, the lower edge of the upper casing 3*a* is set at the same level as the lower face of the main shroud 7. The reason for this design is that the material resin of the upper casing 3*a*is required to be of a high performance compared to that of the lower casing 3*b*, and thus, is expensive. Therefore, the upper casing 3*a* should be made in a small size to reduce the production cost.

Figure 3A:
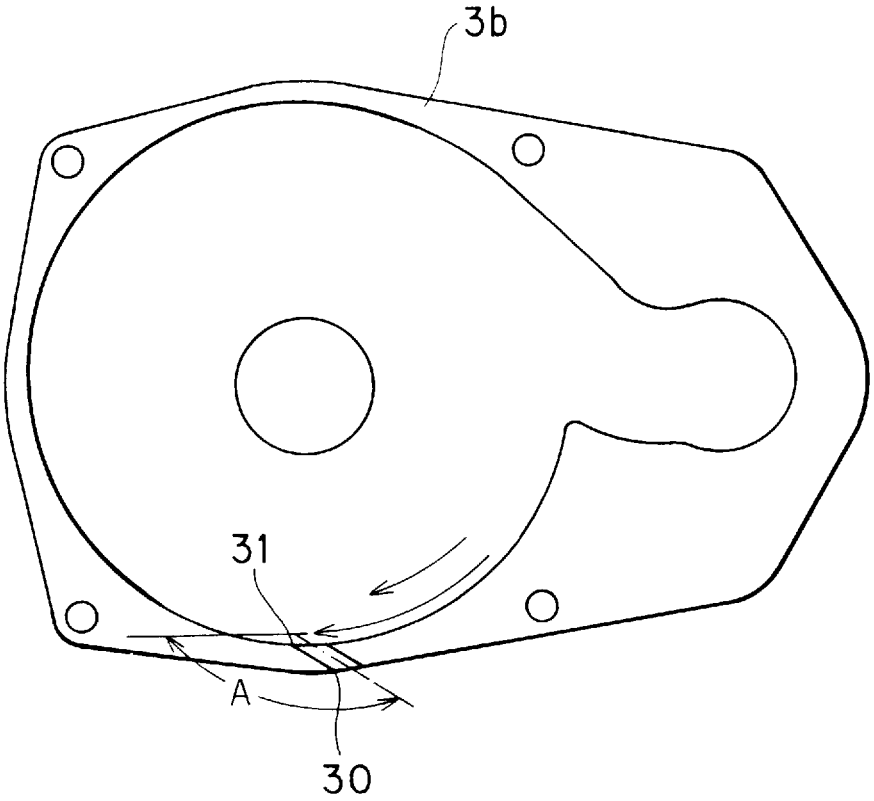
FIG. 3A is a plan view showing a lower casing.
Figure 3B:
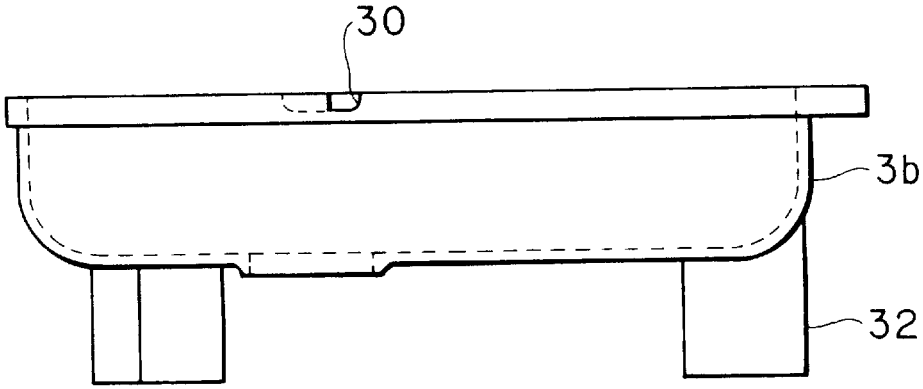
FIG. 3B is a side view showing the lower casing.

On the upper end of the lower casing 3*b*, an air vent hole 30 is formed through the side wall of the pump at an obtuse angle A to the fluid flow direction, as shown in FIGS. 3A and 3B. This is to discharge air aspirated in the pump to prevent an air lock. Such an arrangement of the air vent hole 30 makes it possible to retard the enlargement thereof by increasing the mass of a corner portion 31, which is easy to wear because of friction between the fluid flow, thus leading to a greater life of the pump, as well as to minimize fluid discharge from the air vent hole 30 to maintain pumping efficiency. In the lower face of the lower casing 3*b*, three legs 32 are formed by molding integrally therewith.

The submerged pump described above works as follows. When the submerged pump is placed in a water tank and the motor 2 is turned on, the fluid in the pump chamber 4 is energized in a centrifugal direction by the rotation of the impeller and flows into the discharge portion 5 through the narrowed passage portion 12. During the flow from the inlet portion 9 through the pump chamber 4 to the discharge portion 5, the cross-sectional area of the flow passage does not change extensively so as to minimize energy loss, which leads to improvement of the pumping efficiency. On the other hand, since the cross-sectional area of the flow passage decreases at downstream side of the impeller 6, the pump head can be enhanced at a shut off operation flow rate, that is, at a small flow rate range. This feature also serves to prevent an excess output in a large flow rate range.

According to the present invention, by preparing a projection defining a narrowed passage portion between the pump chamber and the discharge portion, pumping efficiency is maintained, and the head pressure is prevented from being lowered at a shut off operational flow rate, even when the pump casing is made of resin. Thus, the present invention can provide a pump having advantages of a resin material open-type casing, such as light-weight, low cost and highly improved maintenance characteristics as well as a high pumping performance.

Also, by the air vent hole penetrating the outer side wall of the pump chamber being formed at an obtuse angle to the fluid flow in the outer periphery portion of the pump, leakage of the fluid and the wear of border of the hole are reduced, still maintaining the air vent function. Thus, the present invention can provide a pump having a high pumping efficiency and a long life.

Although a certain preferred embodiment of the present invention has been shown and described in detail, it should be understood that various changes and modifications may be made therein without departing from the scope of the appended claims.

What is claimed is:

1. A submerged pump comprising:

a pump casing accommodating a shaft rotatably therein and having an inlet portion, a pump chamber and a discharge portion;

an impeller integrally mounted on said shaft in said pump chamber; and a motor means for driving said impeller to rotate within said pump chamber, said motor means being integrally secured to said pump casing;

wherein said pump casing comprises at least two subcasings assembled together, at least one of said subcasings having a projection defining a narrowed passage portion between said pump chamber and said discharge portion, and a minimum diameter of said narrowed passage portion is substantially equal to a minimum diameter of said inlet portion of said submerged pump.

2. A pump according to claim 1, wherein a gap having a diameter equal to or larger than the minimum diameter of said inlet portion is formed between said impeller and said pump casing.

3. A pump according to claim 1, wherein the cross-sectional area of said narrowed passage portion is almost equal to that of said inlet portion.

4. A pump according to claim 1, wherein an air vent hole penetrating an outer side wall of said pump chamber is formed therein, said air vent hole being at an obtuse angle with respect to a fluid flow direction in an outer portion of said pump.

5. A pump according to claim 1, wherein the highest contacting face between said subcasings is arranged approximately at least as high as a main shroud of said impeller.

6. A submerged pump comprising:

a pump casing accommodating a shaft rotatably therein and having an inlet portion, a pump chamber and a discharge portion;

an impeller integrally mounted on said shaft in said pump chamber; and a motor means for driving said impeller to rotate within said pump chamber, said motor means being integrally secured to said pump casing;

wherein an air vent hole is formed through an outer side wall of said pump chamber, said air vent hole being at an obtuse angle with respect to a fluid flow direction in an outer portion of said pump.

7. A pump according to claim 6, wherein the angle between said air vent hole and said fluid flow direction is substantially in a range of 105°to 165°.

8. A vortex-type submerged pump comprising:

a pump casing accommodating a shaft rotatably therein and having an inlet portion, a pump chamber and a discharge portion;

an impeller integrally mounted on said shaft in said pump chamber; and a motor means for driving said impeller to rotate within said pump chamber, said motor means being integrally secured to said pump casing;

wherein said pump casing comprises at least two subcasings assembled together, at least one of said subcasings having a projection defining a narrowed passage portion between said pump chamber and said discharge portion, wherein a minimum diameter of said passage portion is larger than a minimum diameter of said inlet portion of said submerged pump, and wherein the projection extends beyond a plane of contact of the at least two subcasings.

9. A pump according to claim 8, wherein a gap having a diameter equal to or larger than the minimum diameter of said inlet portion is formed between said impeller and said pump casing.

10. A pump according to claim 8, wherein an air vent hole penetrating an outer side wall of said pump chamber is formed therein, said air vent hole being at an obtuse angle with respect to a fluid flow direction in an outer portion of said pump.

* * * * *